US006895206B2

(12) United States Patent
Nakamura et al.

(10) Patent No.: US 6,895,206 B2
(45) Date of Patent: May 17, 2005

(54) IMAGE FIXING APPARATUS AND IMAGE FIXING METHOD FOR A CRYSTALLINE RESIN-CONTAINING TONER

(75) Inventors: Masaki Nakamura, Minamiashigara (JP); Toshimizu Ozawa, Minamiashigara (JP); Norihito Fukushima, Minamiashigara (JP); Hirokazu Hamano, Minamiashigara (JP); Yuka Ishihara, Minamiashigara (JP); Manabu Serizawa, Minamiashigara (JP); Katsumi Daimon, Minamiashigara (JP)

(73) Assignee: Fuji Xerox Company, Limited, Tokyo (JP)

( * ) Notice: Subject to any disclaimer, the term of this patent is extended or adjusted under 35 U.S.C. 154(b) by 15 days.

(21) Appl. No.: 10/462,763

(22) Filed: Jun. 17, 2003

(65) Prior Publication Data

US 2004/0037596 A1 Feb. 26, 2004

(30) Foreign Application Priority Data

Jul. 18, 2002 (JP) ..... 2002-210142

(51) Int. Cl.[7] ..... G03G 15/20

(52) U.S. Cl. ..... 399/328; 219/216; 399/324; 399/329; 430/109.1; 430/124

(58) Field of Search ..... 399/328, 329, 399/320, 324, 325, 331; 219/216; 430/124, 109.1; 347/156

(56) References Cited

U.S. PATENT DOCUMENTS 6,006,052 A * 12/1999 Kamimura et al. ..... 399/324 X
6,463,252 B2 * 10/2002 Omoto et al. ..... 399/328 X
2002/0154923 A1 * 10/2002 Baker et al. ..... 399/237
2003/0054280 A1 * 3/2003 Ishihara et al. ..... 430/124
2003/0063916 A1 * 4/2003 Katayanagi et al. .... 399/328 X

FOREIGN PATENT DOCUMENTS

| | | | |
|---|---|---|---|
| JP | 04-308868 | * | 10/1992 |
| JP | 04-340577 | * | 11/1992 |
| JP | A 8-314323 | | 11/1996 |
| JP | A 10-133505 | | 5/1998 |
| JP | A 10-149044 | | 6/1998 |
| JP | A 11-24461 | | 1/1999 |
| JP | A 11-161079 | | 6/1999 |
| JP | 2000-122464 | * | 4/2000 |
| JP | 2001-117394 | * | 4/2001 |
| JP | 2001-201979 | * | 7/2001 |
| JP | 2001-312168 | * | 11/2001 |
| JP | 2002-006656 | * | 1/2002 |
| JP | A 2002-72557 | | 3/2002 |
| JP | 2002-207316 | * | 7/2002 |
| JP | 2003-029463 | * | 1/2003 |

* cited by examiner

*Primary Examiner*—Sophia S. Chen
(74) *Attorney, Agent, or Firm*—Oliff & Berridge, PLC

(57) ABSTRACT

An image fixing method capable of favorably fixing a toner containing a crystalline resin is provided. A transfer medium having unfixed images formed of a color toner containing a binder resin that contains a crystalline resin and a colorant is passed between a heating member heated by way of an external heating unit and a pressurizing member, thereby fixing the unfixed images.

19 Claims, 2 Drawing Sheets

IMAGE FIXING APPARATUS AND IMAGE FIXING METHOD FOR A CRYSTALLINE RESIN-CONTAINING TONER

BACKGROUND OF THE INVENTION

1. Field of the Invention

This invention concerns an image fixing method and, more particularly, it relates to an image fixing method suitable to equipment utilizing an electrophotographic process for use in copying machines, printers and facsimiles and, more in particular, color copying machines.

2. Description of the Related Art

In the electrophotographic process, fixed images are formed by way of plural steps of electrically forming latent images by various units on a light sensitive body utilizing a photoconductive material, developing the latent images by use of a toner, transferring latent toner images on the light sensitive body by way of or not by way of an intermediate transfer body to a transfer medium such as paper as toner images and then fixing the transferred images on the transfer medium. In recent years, along with development of equipment and repletion of communication networks in the information society, the electrophotographic process has been utilized not only in copying machines but also generally in office network printers, printers for personal computers, and printers for on demand printing. Then, high image quality, high operation speed, high reliability, reduction in size and weight, and energy saving performance have been demanded more and more irrespective of black and white or color printing.

Particularly, demands for coloration and energy saving performance have increased in recent years.

As a contact type fixing method used generally for the fixing method, a method of utilizing heat and pressure at fixing (hereinafter referred to as "heat pressing method") is used generally. In the case of the heat pressing method, since the surface of a fixing member and toner images on a transfer medium are in contact with each other under pressurization, the heat efficiency is excellent and fixing can be conducted rapidly, which is particularly effective in high speed electrophotographic copying machines.

The fixing temperature performance of the toner contributes significantly to the energy saving performance, and the method of using a crystalline resin for a binder resin is excellent in the low temperature fixing property which is described, for example, in Japanese Laid Open Patent Application No. 2002-72557.

However, while the crystalline resin is melted sharply upon temperature elevation in fixing and can be fixed at a low temperature, it has a nature of less solidifying after fixing. Accordingly, it involves a problem of tending to suffer from damages by a releasing member. Further, in the both-face color printing, since molten toners in plural layers are peeled in the image peeling upon color fixing, it is more difficult than the peeling in the black single layer toner and, accordingly, it adopts a mechanism of conducting peeling preferentially to the heating side, that is, the discharging direction is nearer to the pressurizing member and, as a result, it involves a problem that images on the rear face tends to be roughened upon both-face printing.

Japanese laid Open Patent Applications Nos. H11-161079, H11-24461, H10-149044, H10-133505 and H8-314323, etc. disclose excellent inventions of heating the heating member by an external heating unit but they involve a problem that the fixing speed cannot be increased for keeping the temperature on the surface of the heating member only by external heating in a case of using existent toners of a high fixing temperature. Accordingly, a method of using the internal heating unit is predominant in the heating method for the heating member, and the external heating unit is merely an auxiliary unit that prevents lowering of temperature or an auxiliary heating unit that shortens the heating time.

However, in the method of using the internal heating unit, since a temperature gradient exists from the surface to the inside of the heating member and the internal temperature is higher relative to the surface temperature, the temperature of images upon passing the fixing nip is highest at the exit of the fixing nip. In a case of fixing the toner using a binder resin that contains a crystalline resin in this state, the toner becomes harder to solidify to possibly result in problems such as occurrence of roughing in the images, and damage liable to be caused to the images during transportation.

SUMMARY OF THE INVENTION

This invention intends to overcome the foregoing problems and provide a method of fixing images of toner for electrophotography, which is also suitable to color toners.

The present inventors have noted on the phenomenon of fixing a crystalline resin-containing toner, have made an earnest study and, as a result, have accomplished the present invention based on the finding that a crystalline resin-containing toner capable of fixing at a low temperature can be fixed with reduced energy and at high reliability.

According to one aspect of this invention, an image fixing apparatus passes a transfer medium having unfixed images formed of a color toner for electrophotography containing a binder resin that contains a crystalline resin and a colorant between a heating member and a pressurizing member, thereby fixing the unfixed images, in which the heating member has a heating unit outside the heating member.

According to another aspect of this invention, a method of fixing images passes a transfer medium having unfixed images formed of a color toner for electrophotography containing a binder resin that contains a crystalline resin and a colorant between a heating member and a pressurizing member, thereby fixing the unfixed images, in which the heating member is heated by way of an external heating unit.

DESCRIPTION OF THE ACCOMPANYING DRAWINGS

Preferred embodiments of this invention will be described in detail based on the drawings, wherein.

PREFERRED EMBODIMENT OF THE INVENTION

The method of fixing images according to the present invention for passing a transfer medium having, on at least one surface, unfixed images formed of a color toner for electrophotography containing a binder that contains a crystalline resin and a colorant between a heating member and a pressurizing member, thereby fixing unfixed images in which the heating member is heated by way of an external heating unit.

In the existent system of heating from the inner surface of a heating member, since a temperature gradient is present from the inner surface to the outer surface, heating continues from the inner surface of the heating member also in fixing nip. Accordingly, the temperature of toner images during fixing tends to be elevated and, as a result, solidification is retarded a case of a binder resin that contains a crystalline resin and damage is liable to be caused by contact with a peeling member. In the method of fixing images according to the invention in which the heating member is heated by way of the external heating unit for preventing excess heating in the fixing nip, the temperature for the toner images is not very likely to increase to a temperature than required for fixing and, as a result, solidification of the crystalline resin-containing toner is completed rapidly, thereby suppressing damage caused by contact with the peeling member.

An example of a preferred embodiment for a method of fixing images according to the present invention is to be described in details with reference to the drawings.

Figure 1:
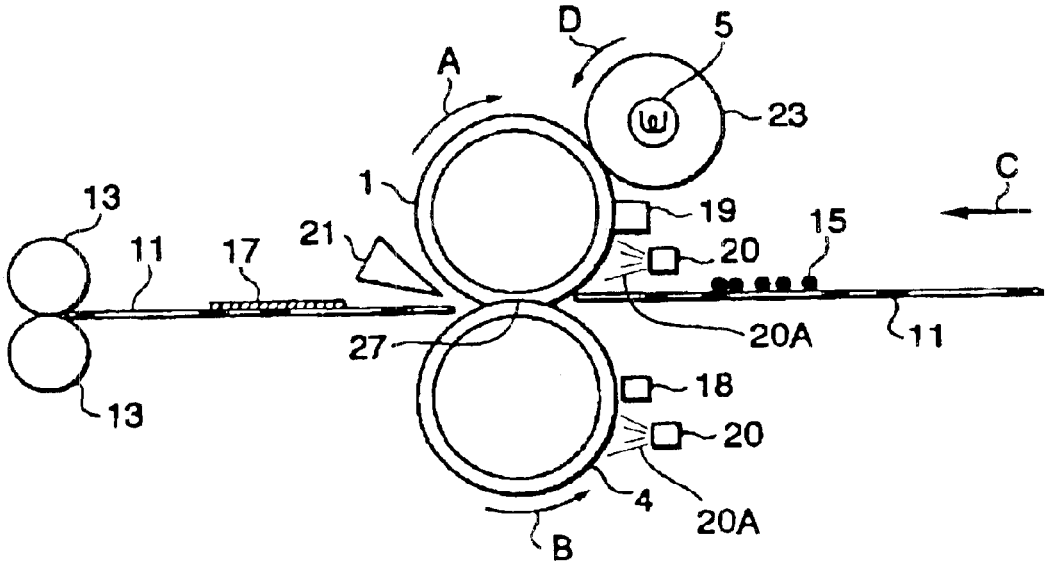
FIG. 1 is a constitutional schematic view of an image fixing apparatus using an external heating roll.

FIG. 1 is a schematic constitutional view of an image fixing apparatus used in the image fixing method according to the invention. The image fixing apparatus shown in FIG. 1 includes a heating roll 1 as a heating member, a pressing roll 4 is a pressurizing member arranged in press contact with the heating roll 1, an external heating roll 23 disposed as an external heating unit in contact with the heating roll 1, a heating lamp 5 disposed inside the external heating roll 23, a temperature sensor 19 located at the surface of the heating roll 1, a temperature sensor 18 located on the surface of the pressing roll 4 and a finger 21. In the apparatus, a fixing nip 27 is formed at a press contact portion by arrangement of the heating roll 1 and the pressing roil 4 in press contact.

In the image fixing apparatus shown in FIG. 1, the heating roll 1 and the pressing roll 4 are rotated in the direction of an arrow A and in the direction of an arrow B, respectively. The external heating roll 23 is heated by the heating lamp 5. The surface of the heating roll 1 is heated by the external heating roll 23 which is driven in contact with the heating roll 1. The surface temperature of the heating roll 1 is always monitored by the temperature sensor 19 and the surface temperature of the heating roll 1 is controlled to a temperature suitable to the fixing of a toner by controlling the heating lamp 5 by an unillustrated control unit.

Since the heating roll 1 is heated by way of the external heating roll 23, temperature gradient does not occur in the inside. Accordingly, excess heating in the fixing nip 27 can be prevented.

A transfer medium 11 having unfixed images 15 formed of a color toner for electrophotography according to the invention is transported by an unillustrated transportation unit in the direction of an arrow C. The transported transfer medium 11 passes through the fixing nip 27. In this step, the unfixed images 15 are in press contact with the surface of the heating roll 1 heated and melted by the external heating roll 23. The molten unfixed images 15 are solidified after passage of the transfer medium 11 through the fixing nip 27 and then fixed to the transfer medium 11 to form fixed images 17.

Then, the transfer medium 11 is discharged by a paper discharging conveyer 13.

The finger 21 has a function of assisting peeling of the transfer medium 11 adhered on the surface of the heating roll 1 at the fixing nip 27.

A heating roll 1 having a rubber elastic layer of a single layered or laminated structure and a releasing layer successively on the metal roll core can be used.

As the material for the metal roll core, a material of excellent heat resistance, having high strength to deformation and showing good heat conductivity is selected and, for example, aluminum, iron and copper can be used. Among them, aluminum and iron am preferred.

The thickness of the rubber elastic layer is preferably from 0.1 mm to 3 mm and, particularly preferably, from 0.3 mm to 2 mm. A material such as silicon rubber or fluoro rubber having heat resistance can be used and the rubber hardness is preferably 70° (JIS-A) or less and, particularly preferably, 60° or less.

As the material for the releasing layer, those materials with low surface energy such as silicon rubber, fluoro rubber, fluoro latex, and fluoro resin may be used Among them, use of the fluoro resin can provide highly reliable fixing performance for a long time.

For the fluoro resin, Teflon(R) such as PFA (perfluoroalkoxy ethyl ether copolymer) and soft fluoro resin containing vinylidene fluoride or the like can be used. Since the fluoro resin does not result in lowering of releasability due to adhesion or deposition of toner contamination compared with silicon rubber or fluoro rubber, life of the heating roll 1 can be extended.

The external heating roll 23 includes a hollow metal roll core. The external heating roll 23 rotates in the direction of the arrow D. A beating lamp 5 such as a halogen lamp is disposed inside the external heating roll 23. The same material as for the heating roll 1 can be used as the material for the metal roll core.

A pressing roll 4 having a rubber elastic layer of a single layered or laminated structure and a releasing layer successively provided on a metal roll core can be used, and concrete examples thereof are identical with those for the heating roll.

When the rubber elastic layer of the heating roll is excessively thick exceeding 3 mm, it is not preferred since the heat capacity of the heating roll increases to take a long time for heating the heating roll 1 to a desired temperature, as well as the consumption energy increases. On the other hand, when the thickness of the rubber layer is as excessively small as less than 0.1 mm, it is not preferred since deformation on the surface of the roll cannot conform the unevenness of the unfixed images 15 to cause uneven melting and strains in the rubber elastic layer effective to the peeling cannot be obtained.

Various kinds of additives may be incorporated, depending on the purpose, to the rubber elastic layer and/or releasing layer of the heating layer Land the pressing roll 4 and they can include, for example, carbon black, metal oxides or particles of ceramic such as SiC with an aim of improving the abrasion resistance and controlling the resistance value.

Figure 2:
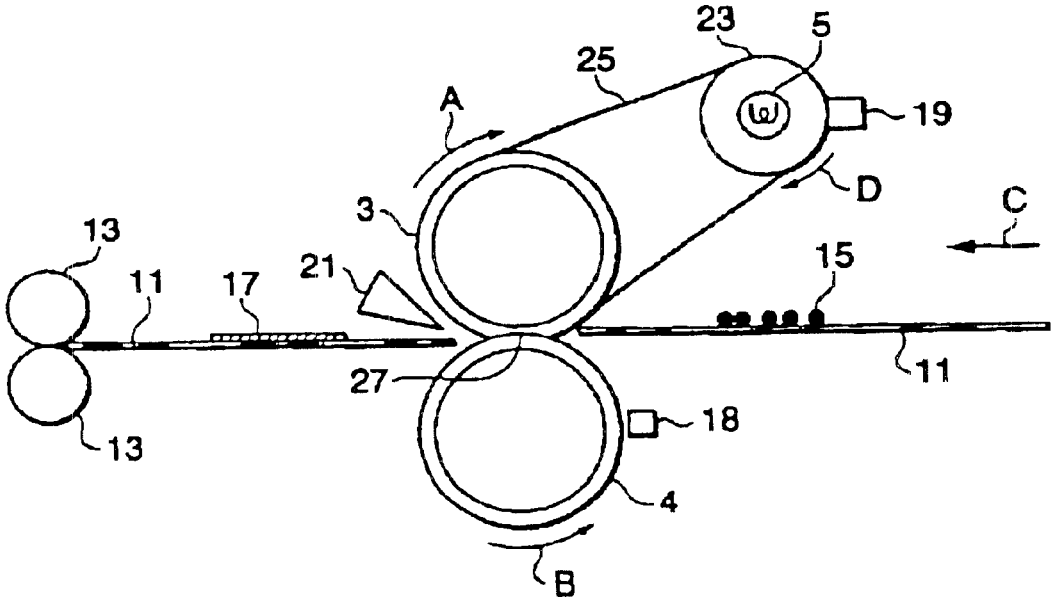
FIG. 2 is a schematic constitutional view of an image fixing apparatus using a heating belt.

FIG. 2 shows another example of an image fixing apparatus usable in the invention.

The image fixing apparatus in FIG. 2 includes a pressurizing roll 3 as a pressurizing member, an external heating roll 23 as an external heating unit, a heating belt 25 as a heating member laid around the heating roll 3 and the external heating roll 23, a pressing roll 4 as a pressurizing member arranged in press contact by way of the heating belt 25 with the pressurizing roll 3, a heating lamp 5 disposed inside the external heating roll 23, a temperature sensor 19 located by way of the heating belt 25 on the surface of the external heating roll 23, a temperature sensor 18 located on the surface of the pressing roll 4, and a finger 21. In the apparatus, a fixing nip 27 is formed at a press contact portion by press contact arrangement of the pressurizing roll 3 and the pressing roll 4 by way of the heating belt 25.

In the image fixing apparatus shown in FIG. 2, the heating roll 3 and the pressing roll 4 are rotated, respectively, in the direction of the arrow A and in the direction of the arrow B. The external heating roll 23 and the heating belt 25 are driven by the pressurizing roll 3. The external heating roll 23 is heated by the heating lamp 5. The heating belt 25 is heated by the external heating roll 23 heated by the heating lamp 5. The surface temperature of the heating belt 25 is always monitored by the temperature sensor 19 and the temperature of the heating belt 25 is controlled to a temperature suitable to the fixing of the toner by controlling the heating lamp 5 by an unillustrated control unit.

Since the heating belt 25 is used as a heating member, the pressurizing roll 3 and the pressing roll 4 constituting the fixing nip 27 are not heated directly by a heating source such as the heating lamp. Accordingly, excess heating for the inside of the fixing nip 27 can be prevented.

The transfer medium 11 having unfixed images 15 formed of a color toner for electrophotography is transported by an unillustrated transportation unit in the direction of an arrow C. The transported transfer medium 11 passes through the fixing nip 27. In this step, the unfixed images 15 are in press contact with the surface of the heating belt 25 heated and melted by the external heating roll 23. The molten unfixed images 15 are solidified after passage of the transfer medium 11 through the fixing nip 27 and then fixed to the transfer medium 11 to form fixed images 17.

Then, the transfer medium 11 is discharged by a paper discharging conveyer 13.

The materials used for the pressing roll 4 and the external heating roll 23 and the like in FIG. 2 are identical with those in FIG. 1. Further, the pressuring roll 3 includes a hollow metal roll core. The same material as that for the heating roll 1 can be used for the material of the metal roll core. The pressurizing roll 3 may further have a heating unit such as a halogen lamp.

For the heating belt 25, those having a rubber elastic layer and a releasing layer of a single layered or laminated structure provided successively on a belt made of a heat resistant resin or stainless steel can be used. The heat resistant resin is selected, for example, from polyimide, polyimide and polyimide-imide and the thickness is, preferably, from 50 to 125 $\mu$m. The releasing layer formed on the surface of the rubber elastic layer is preferably coated with the fluoro resin described above, for example, PFA at a thickness of 5 to 50 $\mu$m.

The thickness of the rubber elastic layer is, preferably, from 0.1 mm to 2 mm.

The same material as that for the heating roll 1 can be used at the material for the rubber elastic layer and the releasing layer.

In the image fixing apparatus used in this invention, a cooling unit that controls the surface temperature of the pressurizing member is preferably disposed. Since roughening of images on the rear face upon both-face printing can be prevented, it is preferred that the external heating unit and the cooling unit are used in combination.

Figure 3:
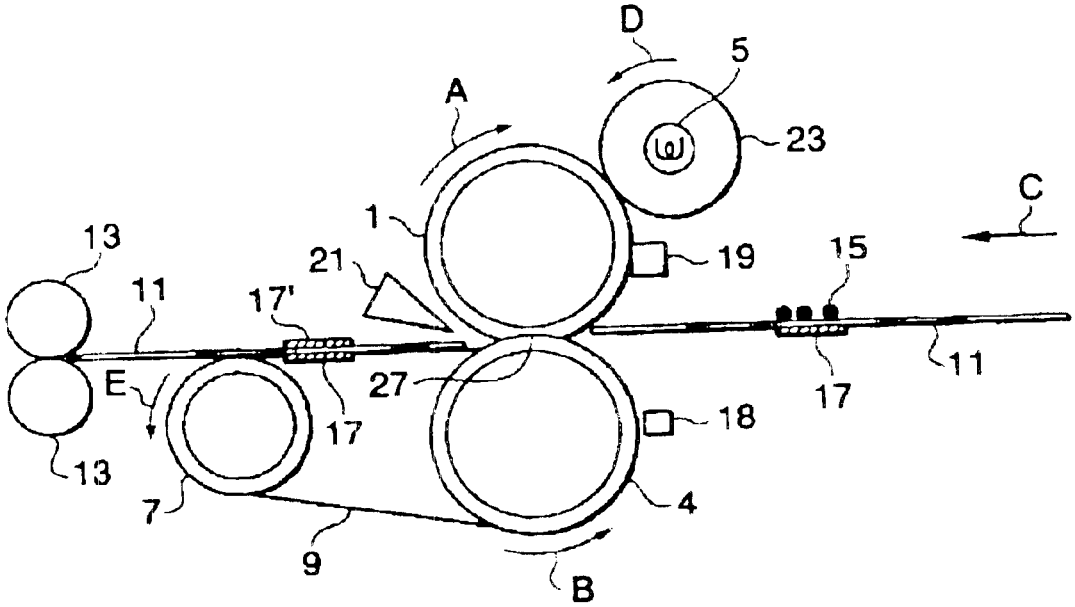
FIG. 3 is a schematic constitutional view of an image fixing apparatus using an external heating roll and further provided with a cooling unit for a pressurizing member.
Figure 4:
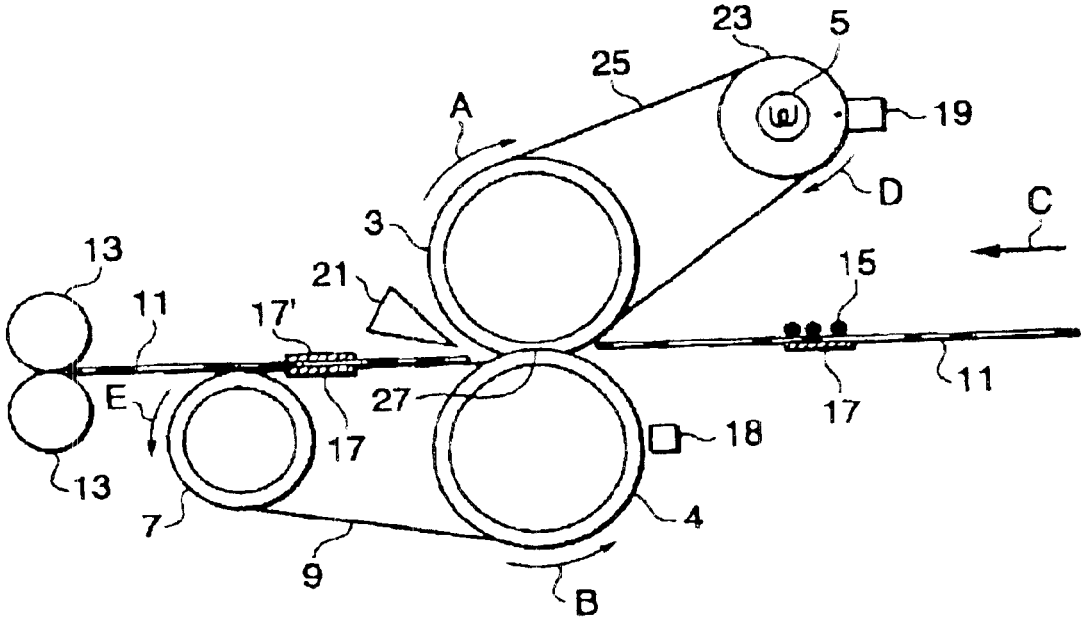
FIG. 4 is a schematic constitutional view of an image fixing apparatus using a heating belt and further provided with a cooling unit for a pressuring member.

FIG. 3 and FIG. 4 show, respectively, image fixing apparatuses with cooling units that control the surface temperature of the pressurizing members (cooling roll 7 and cooling provided to the image fixing apparatuses shown in FIG. 1 and FIG. 2, respectively.

The cooling units are to be described with reference to FIG. 3.

A pressing roll 4 is arranged in press contact with a heating roll 1 by way of a cooling belt 9. The cooling belt 9 is laid around the pressing roll 4 and the cooling roll 7. Since the pressing roll 4 and the heating roll 1 are arranged in press contact with each other by way of the cooling belt 9, a fixing nip 27 is formed to a press contact portion.

The cooling roll 7 and the cooling belt 9 are driven in the direction of an arrow E along with the rotation of the pressing roll 4. The cooling belt 9 is cooled by the cooling roll 7 while the pressing roll 4 is cooled by the cooling belt 9. In this embodiment, movement of other members such as the heating roll 1 is identical with that of FIG. 1.

A transfer medium 11 having fixed images 17 on one side and unfixed images 15 on the other side are transported by an unillustrated transportation unit in the direction of an arrow C. The transported transfer medium 11 passes through the fixing nip 27. In this step, the unfixed images 15 are in press contact with the surface of the heating roll 1 heated by the external heating roll 23 and melted. The molten unfixed images 15 are solidified after the passage of the transfer medium 11 through the fixing nip 27 and then fixed to the transfer medium 11 to form fixed images 17'. Further, since the cooling belt 9 disposed on the surface of the pressing roll 4 is cooled by the cooling roll 7, the fixed images 17 are not substantially melted and do not cause image failure such as unevenness of gloss when the transfer medium 11 passes through the fixing nip 27.

In a case where the binder resin contained in the toner forming the fixed images 17 contains the crystalline resin according to the invention, the surface temperature of the cooling belt 9 is preferably at a melting point of the crystalline resin +30° C. or lower and, particularly, at a melting point of the crystalline resin +Y° C. or lower in which Y is represented by the following equation:

$$Y=0.3X-18$$

where X represents a transfer medium transporting speed (mm/sec) of the image fixing apparatus which is less than 160 mm/sec.

In a case where the transportation speed of the transfer medium is low, since the heating time during fixing nip is increased, the temperature of the fixed images on the side of the pressurizing member tends to elevate, so that unevenness in the peeling of the images due to remelting tends to occur and, accordingly, it is preferred to control the surface temperature of the pressurizing member lower.

The surface temperature of the cooling belt 9 means a temperature immediately after passing 99 sheets of transferred bodies continuously. The surface temperature of the cooling belt 9 before passage of the sheet does not matter.

Then, the transfer medium 11 is discharged by a paper discharging conveyer roll 13.

The cooling roll 7 has a hollow metal roll core as the constituent element thereof. The same material as that for the heating roll 1 can be used for the material of the metal roll core.

The cooling roll 7 is cooled by circulating air or coolant in a hollow portion of by way of an unillustrated circulation device.

The cooling belt 9 preferably includes a base layer and a releasing layer covered on the surface thereof, with a rubber elastic layer being optionally provided between them. The base layer is selected, for example, from polyimide, polyimide and polyimide-imide and the thickness is, preferably, from 50 to 125 $\mu$m. As the releasing layer formed on the surface of the base layer, the fluoro resin as described above, for example, PFA coated to a thickness of 5 to 50 $\mu$m is preferred.

When the cooling belt 9 has a rubber elastic layer, the pressing roll 4 may, optionally, have a rubber elastic layer.

In a case of cooling the pressurizing member by use of a cooling unit, it may be embodied such that a pressing roll 4 is cooled by arranging the pressing roll 4 in direct contact with the cooling roll 7 in FIG. 3. Further, it may be of such an embodiment as not using the cooling roll but jetting air or the like directly to the pressing roll, thereby cooling the pressurizing member.

In the image fixing apparatus, a cleaning member for removing a toner deposited on the surface of the heating member may further be provided optionally.

Since the color toner for electrophotography according to the invention is excellent in the releasability, application of a releasing agent 20A to the surface of a fixing member by a releasing agent unit 20 is not particularly required in a case of using fixing members such as a heating member and a pressurizing member having a releasing layer formed of material with low surface energy but the releasing agent may be applied on the surface of the fixing member with a view point of improving the durability and the releasability thereof, and the application amount is, preferably, from $1.6\times10^{-5}$ to 8.0×10−4 mg/cm$^2$.

A smaller application amount of the releasing agent is preferred with a view point of smoothness and gloss of the obtained images. However, if the application amount of the releasing agent is reduced to 0 mg/cm$^2$, the wear amount of the fixing member increases when the fixing member and the transfer medium are in contact with each other during image fixing to possibly lower the durability of the fixing member. Accordingly, the releasing agent is preferably applied by a slight amount to the fixing member with a practical point of view.

When the amount of the releasing agent supplied exceeds $8.0\times10^{-4}$ mg/cm$^2$ (0.5 mg per A4-size sheet), it results in a problem that lowering of image quality occurs remarkably in a case of a transfer medium that utilizes transmitting light such as in an OHP due to the releasing agent remaining on the surface of images after fixing. Further, the releasing agent deposits to the transfer medium to cause sticking. Further, when the amount of the releasing agent supplied increases, the capacity of a tank for storing the releasing agent is also increased to result in a problem of enlarging the size of the image fixing apparatus.

The amount of the releasing agent supplied is measured as described below. That is, when common paper used in usual copying machines as the transfer medium (typically, copy paper manufactured by Fuji Xerox Co. Ltd., trade name of products: "J paper") is passed through the fixing member with the releasing agent being supplied on the surface, the releasing agent deposits on the common paper. The releasing agent on the common paper is extracted by use of a Soxhlet's extractor. Hexane is used for the solvent. By quantitative measurement of the releasing agent contained in hexane by an atomic absorption analyzer, the amount of the releasing agent deposited on the common paper is measured quantitatively. The amount is defined as the amount of the releasing agent supplied to the fixing member.

There is no particular restriction on the releasing agent used in the invention and it can include a liquid releasing agent such as a heat resistant oil, for example, dimethyl silicone oil, fluoro oil, fluoro silicone oil or modified oil such as amino modified silicone oil.

As the releasing agent, fluoro oil, fluoro silicone oil, and the like which have high performance but are expensive can also be used with no practical problem in view of the cost since the required amount of the releasing agent supplied may be extremely small.

There is no particular restriction on the method of supplying the releasing agent to the surface of the fixing member in the image fixing apparatus, and the method can include, for example, a pad method, a web method or a roller method using liquid releasing agent impregnated therein or a non-contact type shower method (spray method). Among them, the web method and the roller method are preferred with a view point that the releasing agent can be supplied uniformly and the supplied amount can be controlled easily. For supplying the releasing agent uniformly over the entire fixing member by the shower method, it is necessary to use a blade or the like separately.

The material of the transfer medium used in the invention can include, for example, common paper used in copying machines or printers of electrophotographic systems and OHP sheets. For further improving the planarity on the surface of the images after fixing, it is preferred that the surface of the transfer medium may also be as smooth as possible and, for example, coated paper formed by coating the surface of the common paper with a resin or art paper for use in printing can be used suitably Then, a description is to be made for the color toner for electrophotography according to the invention.

The color toner for electrophotography contains a binder resin that contains a crystalline resin, a colorant and, optionally, other ingredients as the case may be.

In the invention, "crystalline resin" means a resin having a clear heat absorption peak relevant to the melting point in the differential scanning calorimetry (DSC). Since this is an adhesive ingredient that contributes to the low temperature fixing property of the binder resin, the weight average molecular weight is, preferably, 4,000 or more and, more preferably, 7,000 to 100,000.

The melting point of the crystalline resin is, preferably, 40 to 120° C. and, more preferably, 60° C. to 90° C.

Since the viscosity of the crystalline resin lowers abruptly when the temperature exceeds the melting point, it causes blocking when stored at a higher temperature. This is because the toner tends to deform significantly as a whole to increase the area of contact between each of the toner particles. Then it is necessary that the crystalline resin has a melting point higher than the temperature during storage or use, that is, 40° C. or higher and, preferably, it has a melting point of 60° C. or higher. On the other hand, if the melting point is excessively high, low temperature fixing cannot sometimes be attained.

The melting point can be determined as a melting peak temperature in the input compensation differential scanning calorimetry shown in JIS-K-7121. While plural melting peaks are sometimes shown, the maximum peak is regarded as the melting point.

There is no particular restrictions on the crystalline resin so long as the resin can satisfy the conditions described above, and the resin may be selected properly depending on the purpose and can include, for example, polyolefin resin, polydiene resin, and polyester resin. The resins may be used each alone or two or more kinds of them may be used together. Among them, the polyester resin is preferred in view of easy use.

The polyolefin resin can include homopolymers and copolymers of olefinic monomers and can include, as specific example, polybutene, poly-3-metyl-1-butene, polypentene, poly-5-methyl-1-hexene, polytetradecene, polypentadecene, polyhexadecene, polyheptadecene, polyoctadecene, polynonadecene, polyeicosene, polycycloheptene-alt-ethylene, and copolymers containing monomer ingredients of the polymers described above.

In the invention, polyolefins of excessively lower melting points or polyolefins of excessively higher melting points, for example, polyethylene or polypropylene can be used also as the crystalline resin by copolymerization with other olefin ingredients or copolymerizing with acrylic acid, acrylate ester, methacrylic acid, methacrylate ester, vinyl alcohol, vinyl acetate, maleic acid anhydride, and the like (specifically, polyethylene ethyl acrylate can be mentioned).

The polydiene resin can include homopolymers and copolymers of the diene monomers and specific examples can include, for example, trans-1,4-poly-1,3-butadiene, cis-2-tertiary butyl-1,4-poly-1,3-butadiene, trans-1-methoxy-1,4-poly-1,3-butadiene, transchloroprene, trans-1,4-polyisoprene, isotactic-trans-1,4-poly-1,3-pentadiene, isotactic-trans-1,4-poly-1,3-heptadiene, isotactic-trans-6-methyl-1,4-poly-1,3-heptadiene, isotactic-trans-1,4-poly-1,3-hexadiene, isotactic-trans-5-methyl-1,4-poly-1,3-hexadiene, trans-erythro-di-isotactic-2,5-poly-2,4-hexadiene, isotactic-trans-1,4-poly-1,3-octadiene, and copolymers of monomer ingredients of the polymers described above.

Specific examples of the polyester resins can include, for example, poly-1,2-cyclopropendimethylene isophthalate, polydecamethylene adipate, polydecamethylene azelate, polydecamethylene oxalate, polydecamethylene sebacate, polydecamethylene succinate, polyeicosamethylene malonate, polyethylene-p(carbophenoxy) butylate, polyethylene-p-(carbophenoxy) undecanoate, polyethylene-p-phenylenediacetate, polyethylene sebacate, polyethylene succinate, polyhexamethylene carbonate, polyhexamethylene-p-(carbophenoxy) undecanoate, polyhexamethylene oxalate, polyhexamethylene sebacate, polyhexamethylene suberate, polyhexamethylene succinate, poly-4,4-isopropylidenediphenylene adipate, poly-4,4-isopropylidenediphenylene malonate, trans-poly-4,4-isopropylidenediphenylene-1-methylcyclopropane dicarboxylate, polynonamethylene azelate, polynonapethylene terephthalate, polyoctamethylenedodecanediate, polypentamethylene terephthalate, tns-poly-m-phenylenecyclopropane dicarboxylate, cis-poly-m-phenylenecyclopropane dicarboxylate, polytetramethylene carbonate, polytetramethylene-p-phenylene diacetate, polytetramethylene sebacate, polytrimethylene dodecandioate, polytrimethylene octadecanedioate, polytrimethylene oxalate, polytrimethylene undecandioate, poly-p-xylene adipate, poly-p-xylene azelate, poly-p-xylene sebacate, polydiethylene glycol tertephthalate, cis-poly-1,4-(2-butene) sebacate, polycaprolactone, and copolymers of the monomer ingredients of the polymers described above.

The content of the crystalline resin in the binder resin is, preferably, from 20 to 50 mass % and, particularly preferably, 20 to 30 mass %. With the content of the crystaline resin in the range described above, a toner excellent in the low temperature fixing property can be obtained.

The binder resin may contain an amorphous resin together with the crystalline resin.

In the invention, "amorphous resin" means a resin which is solid at a normal temperature and becomes thermoplastic at a temperature higher than the glass transition point, which shows stepwise change in the heat absorption amount in the differential scanning calorimetry (DSC), different from the distinctive heat absorption peak observed in the case of the crystalline resin described above.

The amorphous resin usable in the invention can include polyimide resin, polycarbonate resin, polyether resin, polyacrylonitrile resin, polyallylate resin, polyester resin and styrene-acrylic resin. Among them, the polyester resin is preferred in view of the low temperature fixing property.

The amorphous polyester resin can be prepared usually by polycondensation of a dicarboxylic acid ingredient and a diol ingredient as the monomers.

Specifically, the dicarboxylic acid ingredient is, preferably, terephthalic acid, isophthalic acid, cyclohexane dicarboxylic acid, naphthalene dicarboxylic acid such as naphthalene-2,6-dicarboxylic acid, naphthalene-2,7-dicarboxylic acid, and biphenyl dicarboxylic acid. The diol ingredient is preferably ethylene glycol, propylene glycol, neopentyl glycol, cyclohexane dimethanol, ethylene oxide bisphenol A adduct and trimethylene oxide bisphenol A adduct.

Each of the dicarboxylic acid ingredient and the diol ingredient may be used alone or two or more of them may be used together.

The molecular weight of the binder resin suitable to the invention is about 4,000 to 100,000 in weight average molecular weight Mw. The molecular weight can be measured by a known method and it is generally measured by gel permeation chromatography (hereinafter simply referred to as "GPC"). GPC measurement can be conducted by use of, for example, HLC-802A manufactured by TOYO SODA Co., as the GPC device, under the conditions at an oven temperature of 40° C., a column flow rate of 1 ml/min and a sample injection amount of 0.1 ml, at a sample concentration of 0.5% and using THF for GPC manufactured by Wako Junyaku Co. Further, calibration curves can be prepared by use of, for example, a standard polystyrene specimen manufactured by TOYO SODA Co. The molecular weight and the distribution of the molecular weight were measured by the method described above in the invention.

In addition to the preferred monomers described above, the monomers shown below can also be used together.

The bivalent carboxylic acid can include, for example, dibasic acid such as succinic acid, glutaric acid, adipic acid, suberic acid, azelaic acid, sebacic acid, phthalic acid, malonic acid and mesaconic acid, as well as anhydrides thereof and lower alkyl esters thereof, and unsaturated aliphatic dicarboxylic acids such as maleic acid, fumaric acid, itaconic acid and citraconic acid. Further, the tri- or higher valent carboxylic acids that can be used together in a slight amount can include, for example, 1,2,4-benzene tricarboxylic acid, 1,2,5-benzene tricarboxylic acid, 1,2,4-naphthalene tricarboxylic acid, as well as anhydrides thereof and lower alkyl esters thereof. They may be used each alone or two or more kinds of them may be used together.

Dihydric alcohols can include, for example, bisphenol A, hydrogenated bisphenol A, 1,4-cyclohexanediol, 1,4-cyclohexanedimethanol, diethyleneglycol, dipropyleneglycol, 1,3-butanediol, 1,4-butanediol, 1,5-pentanediol, 1,6-hexanediol and neopentylglycol. Further, tri- or higher-hydric alcohols that can be used together in a slight amount can include, for example, glycerin, trimethylol ethane, trimethylol propane and pentaerythritol. They may be used each alone or two or more of them may be used in combination.

With an aim of controlling the acid value or hydroxyl value, a monobasic acid such as acetic acid or benzoic acid or monohydric alcohol such as cyclohexanol and benzyl alcohol can also be used.

The polyester resin used in the invention can be synthesized by selecting and combining preferred monomer ingredients described above and by use of known methods described, for example, in Polycondensation (Kagaku Dojin), High Molecule Experimentology (Polycondensation and Polyaddition: KYORITSU SHUPPAN) or Polyester Resin Handbook (edited by THE NIKKAN KOGYO SHIMBUN) and, specifically, an ester exchange method and a direct polycondensation method can be used each alone or in combination.

There is no particular restriction on the colorant and known colorants can be mentioned and properly selected depending on the purpose. They can include, for example, carbon black, lamp black, aniline blue, ultramarine blue, chalcoyl blue, methylene blue chloride, copper phthalocyanine, quinoline yellow, chrome yellow, dupont oil red orient oil red, rose bengal, malachite green oxalate, nigrosin die, C.I. pigment red 48: 1, C.I. pigment red57: 1, C.I. pigment red 81: 1, C.I. pigment red 122, C.I. pigment yellow 97, C.I. pigment yellow 12, C.I. pigment yellow 17, C.I. pigment blue 15: 1, and C.I. pigment blue 15: 3.

The content of the colorant is, preferably, from 1 to 30 mass parts based on 100 mass parts of the binder resin and a greater amount is preferred within such a range as not deteriorating the smoothness of the image surface after fixing. When the content of the colorant is increased, the thickness of the images can be reduced upon obtaining images at an identical density, which is advantageous in the effectiveness for the prevention of offset Yellow toner, magenta toner, cyan toner, and black toner can be prepared in accordance with the type of the colorant.

As other ingredients described above, wax can be used as a releasing agent at fixing. The wax include, for example, paraffin wax such as low molecular weight polypropylene or low molecular weight polyethylene, silicon resin, rosin, rice wax and carnauba wax. Among them, those having a melting point of 40° C. to 150° C. are preferred and those having a melting point of 70° C. to 110° C. are more preferred. However, excessive content of the wax may possibly worsen the color image quality and the reliability, such that the wax present on the surface or inside of the color fixing images worsens the projection property of OHP; the wax in the toner transfers by friction to the carrier to change the charging performance of the developer with time in use to a two-component developer; the wax transfers to a charging blade by friction between the toner and the blade to change the charging performance of the developer with time when it is used as one-component developer, and the fluidity of the toner is worsened. The content of the wax is, preferably, from 0.1 to 15%, more preferably, 0.5 to 12% and, further preferably, 0.5 to 10% in the color toner for electrophotography.

In the color toner for electrophotography, various known additives can be used together for the improvement of characteristics within a range not deteriorating the effect of the invention. There is no particular restriction on the additive ingredients and they may be properly selected depending on the purpose and can include, for example, various kinds of additives known per se such as fine inorganic particles, fine organic particles, charge controller and releasing agent.

The fine inorganic particles can include, for example, silica, alumina, titanium oxide, barium titanate, magnesium titanate, calcium titanate, strontium titanate, zinc oxide, silicic sand, clay, mica, wollastonite, diatomaceous earth, cerium chloride, red iron oxide, chromium oxide, cerium oxide, antimony trioxide, magnesium oxide, zirconium oxide, silicon carbide, and silicon nitride. Among them, fine silica particles are preferred and, particularly, fine silica particles put to hydrophobic treatment are preferred. The fine inorganic particles are used generally with an aim of improving the fluidity. The average primary particle size of the fine inorganic particles is, preferably, from 1 to 1000 nm and, particularly preferably, from 10 to 300 nm. The addition amount is, preferably, from 0.01 to 20 mass parts based on 100 mass parts of the color toner for electrophotography.

The fine organic particles can include, for example, polystyrene, polymethyl methacrylate and polyvinyliden fluoride. The fine organic particles are used generally with an aim of improving the cleaning property or transferring property.

The charge controller can include, for example, metal salicylate, metal-containing azo compound, nigrosin and quaternary ammonium salt. The charge controller is used generally with an aim of improving the chargeability.

The color toner for electrophotography can be prepared in accordance with the production process known per se. There is no particular restriction on the production process which can be decided properly in accordance with the purpose. For example, the dry toner production process can include, for example, a kneading pulverization method and kneading freeze pulverization method, and the wet toner production process can include, for example, an in-liquid drying method described for example in Japanese Laid Open Patent Application No. S63-25664, a method of stirring a molten toner under sharing in an insoluble liquid into fine particles and a method of dispersing a binder resin and a colorant in a solvent and then jet-spraying them into fine particles.

EXAMPLE

The present invention is to be described specifically with reference to examples but the invention is not restricted by the examples.

(Synthesis of Amorphous Polyester Resin)

In a reaction vessel equipped with a stirrer, a thermometer, a condenser and a nitrogen gas introduction tube, are charged 161.02 mass parts of dimethyl terephthalate, 46.8 mass parts of dodecenyl succinic acid, 5.04 mass parts of trimethyl trimellitate, 113.5 mass parts of 2 mol of ethylene oxide bisphenol A adduct, 260.6 mass parts of polypropylene oxide bisphenol A adduct, 4.34 mass parts of ethylene glycol, and 3.0 mass parts of dibutyl tin oxide as a catalyst and, after replacing the inside of the reaction vessel with a dry nitrogen gas, they are reacted in a nitrogen gas stream, at about 200° C. for about five hours under stirring and then further reacted under stirring for about five hours while elevating the temperature to about 240° C., to obtain a colorless transparent amorphous polyester resin A.

The amorphous polyester resin A has a molecular weight of Mn 4500 and Mw 3000 by GPC, and a glass transition temperature of 67° C.

The glass transition temperature (Tg) can be measured, for example, by use of a differential scanning calorimeter (DSC 3110, Thermal Analysis System 001: manufactured by Mack Science Co.: hereinafter simply referred to as "DSC") under the condition at a temperature elevation rate of 5° C./min, and the temperature at a shoulder on the low temperature side of a heat absorption point corresponding to Tg of the resultant chart can be determined as Tg. Tg in the invention is measure as described above.

(Synthesis of Crystalline Polyester Resin)

A crystalline polyester resin B is obtained in the same manner as in the synthesis of the amorphous polyester resin from 150 mass parts of ethylene glycol, 200 mass parts of sebacic acid, and 0.2 mass parts of dibutyl tin oxide as a catalyst Molecular weight measured by GPC is Mn 8000 and Mw 26000, and the melting point is 69.5° C.

(Preparation of Crystalline Resin-containing Toner)

59 mass parts of an amorphous polyester resin A, 30 mass parts of a crystalline polyester resin B, 4 mass parts of a cyan die (Cyanine Blue 4933M: manufactured by Dainichi Seika Co.) as a colorant, and 7 mass parts of carnauba wax are melt kneaded in a Banbury mixer type kneader. The kneading product is molded by a milling roll into a plate shape of about 1 cm in thickness, coarsely pulverized to about several millimeters by a fitz mill pulverizer, finely pulverized by an IDS pulverizer and successively classified by an Elbow classifier to obtain a toner. 3 mass % of hydrophobic silica powder (R972, manufactured by Nippon Aerosil Co.) is added to the obtained toner to prepare a toner.

Instead of the cyanine die, a magenta die (Seika First Carmine 1476T-7; manufactured by Dairichi Seika Co.), a yellow pigment (Seika First Yellow 2400; manufactured by Dainichi Seika Co.), carbon black (Carbon Black #25; manufactured by Mitsubishi Chemical Co.) are used to prepare a magenta toner, a yellow toner and a black toner, respectively, to obtain a four-full-color toner. The obtained toner containing the crystalline resin is referred to as a toner AB1. The grain size distribution of the toner is measured by a Coulter counter TA-II type device (manufactured by Coulter Co.).

(Preparation of Amorphous Toner)

89 mass parts of an amorphous polyester resin A, 4 mass parts of a cyanine die (Cyanine Blue 4933M, manufactured by Dainichi Seika Co.) and 7 mass parts of carnauba wax are used to prepare an amorphous toner A in the same manner as in preparation for the toner containing the crystalline resin.

(Preparation of Developer)

7 mass parts of a toner AB1 and 93 mass parts of a carrier are mixed to prepare a developer for electrophotography. As the carrier, a resin-coated type carrier formed by coating a mixture of an amino group-containing vinyl polymer and a fluoro alkyl group-containing vinyl polymer on a ferrite core is used.

(Outline of an Image Outputting Apparatus)

As an image outputting apparatus, an apparatus modified from an image fixing apparatus Acolor 635 (manufactured by Fuji Xerox Co., Ltd.) is used.

Example 1

As shown in FIG. 4, an image fixing apparatus used has a heating belt overheated by an external heating roll as a heating member and having a pressing roll in which a cooling belt cooled by a cooling roll is disposed on the surface thereof as a pressurizing member.

As the heating belt, a polyimide belt of 100 $\mu$m in thickness coated at the surface thereof with a silicon rubber layer of 0.5 mm thickness according to JIS-A40° and having a PFA resin layer of 25 $\mu$m in thickness on the surface thereof is used.

As the cooling belt, a polyimide belt of 75 $\mu$m in thickness coated at the surface thereof with a silicon rubber layer of 0.2 mm ion thickness according to JIS-A40° and having a PFA resin layer of 25 $\mu$m in thickness on the surface thereof is used.

Further, the fixing nip width is set to 6 mm.

A silicone oil is applied to the image fixing apparatus by attaching a silicone oil dip roll to the heating belt, the application amount is controlled by a blade to define the application amount to 0.1 mg per sheet of A4-size paper ($1.7\times10^{-4}$ mg/cm$^2$). For the measurement of the application amount of the silicone oil, white paper is passed through the image fixing apparatus, the oil-deposited white paper is put to a Soxhlet's extractor and the oil is extracted by use of hexane as a solvent and the amount of the oil is determined quantitatively by an atom absorption analyzer.

As the cooling unit for the cooling belt, as shown in FIG. 4, a cooling roll driven by a pressing roll is used and air is supplied to the cooling roll to control the surface temperature of the cooling belt to a temperature below 99.5° C., which is the melting point of the crystalline polyester resin +30° C. Cooling is conducted by use of a small-sized blower at 24 V DC, 0.13 A (beta SLD08T-24TU24H7 by NIDEC) and blowing air collects by a blower through the cooling roll. Further, the temperature for the beating belt is set to 130° C. The transportation speed of the transfer medium of the image fixing apparatus is set to 160 mm/sec.

Black toner, cyan toner, magenta toner and yellow toner of the toner AB1 are overlaid at a size of 180 mm×50 mm to the top end of color paper manufactured by Fuji Xerox Co., Ltd. (J paper) to fix images for 1.5 mg/cm$^2$ by use of the image fixing apparatus described above.

A paper-passing test is conducted under the conditions described above continuously for 99 sheets and the surface temperature of the pressurizing roll is monitored and the peeling performance is evaluated. The peeling property is evaluated by conducting fixing at the first surface, successively, preparing unfixed images on the rear face, conducting fixing again and visually evaluating the absence or presence of image defects cause by peeling failure on both surfaces.

Reference Example 1

The lowest fixing temperature for the amorphous toner A1 and the crystalline resin-containing toner AB1 are compared by use of the image fixing apparatus of Example 1 while changing the temperature of the heating roll. The lowest fitting temperature of the crystalline resin-containing toner AB1 is 95° C. and the lowest fixing temperature of the amorphous toner A1 is 140° C. There is no difference for the fixing temperature depending on the colorant of the toner.

Comparative Example 1

An image fixing apparatus including a heating roll using an internal heating unit formed by coating a silicon rubber layer according to JIS-A45° of 2.7 mm thickness on an aluminum core and having a PFA resin layer of 25 $\mu$m in thickness on the surface thereof and a pressing roll formed by coating a silicon rubber layer according to JIS-A55° of 1 mm in thickness on an aluminum core and having a PFA resin layer of 25 $\mu$m in thickness on the surface thereof is used, and the heating roll is set to a temperature of 130° C. Further, the fixing nip width is set to 6 mm. The transportation speed of the transfer medium in the image fixing apparatus is set to 160 mm/sec.

The silicone oil is applied to the image fixing apparatus by attaching a silicone oil dip roll to the heating belt, the application amount is controlled by a blade and the application amount is set to 0.1 mg per sheet of A4-size paper ($1.7\times10^{-4}$ mg/cm$^2$).

Images with an amount of the toner AB1 of 1.5 mg/cm$^2$ are fixed at a size of. 180 mm×50 mm to the top end of a color paper manufactured by Fuji Xerox Co., Ltd. (J paper)

by use of the image fixing apparatus described above. The evaluation method is identical with that in Example 1.

(Result of Evaluation)

In Example 1, there are no image defects caused by contact between the fixed images and the peeling finger for both of the surfaces of both-face print and there is no peeling unevenness caused by peeling failure of the images on the side of the pressurizing belt, and satisfactory images are obtained. For the surface temperature of the pressurizing roll, the surface temperature of the pressurizing roll don't exceed 99.5° C. during continuous paper passing for 99 sheets and the surface temperature of the pressurizing roll immediately after passing 99 sheets is 95° C., and there are no image defects by peeling on the solid images at the rear face, either.

In Comparative Example 1, image defects cause by contact between the fixed images and the peeling finger are observed for both surfaces of the both-face print and, further, uneven peeling also occurres upon peeling of the images on the side of the pressurizing belt and unevenness in the gloss is observed. Referring to the surface temperature for the pressurizing roll, the surface temperature of the pressurizing roll exceeds 100° C. after passing 50 sheets of paper and the surface temperature of the pressurizing roll after passing 99 sheets of paper is 115° C. and unevenness in the gloss caused by the peeling failure is observed in the solid images at the rear face.

The crystalline resin-containing toner could be fixed with no image defects by use of the image fixing method according to the present invention.

The entire disclosure of Japanese Patent Application No. 2002-210142 filed on Jul. 18, 2002 including specification, claims, drawings and abstract is incorporated herein by reference in its entirety.

What is claimed is:

1. An image fixing apparatus comprising a heating member and a pressurizing member, thereby fixing an unfixed image on a transfer medium, wherein the heating member has a heating unit outside the heating member, and the unfixed image is formed of a color toner containing a binder resin that contains a crystalline resin and a colorant; and a surface temperature of the pressurizing member is controlled so as to be at a melting point of the crystalline resin +30° C. or lower.

2. An image fixing apparatus according to claim 1, wherein the heating unit is a heating roll.

3. An image fixing apparatus according to claim 1, further comprising a unit that applies a releasing agent on surfaces of the heating member and the pressurizing member.

4. An image fixing apparatus according to claim 3, wherein an application amount of the releasing agent is from $1.6\times10^{-5}$ to $8.0\times10^{-4}$ mg/cm$^2$.

5. An image fixing apparatus according to claim 1, wherein a melting point of the crystalline resin is within a range from 40° C. to 120 C.

6. An image fixing apparatus according to claim 1, wherein a content of the crystalline resin in the binder resin is from 20 to 50 wt %.

7. An image fixing apparatus according to claim 1, wherein the binder resin contains an amorphous resin.

8. An image fixing apparatus according to claim 1, further comprising a cooling unit that controls a surface temperature of the pressurizing member.

9. An image fixing apparatus according to claim 8, wherein the cooling unit is a cooling roll.

10. An image fixing apparatus according to claim 8, wherein the cooling unit is a cooling belt.

11. A method of fixing an image, comprising of fixing an unfixed image formed of a color toner containing a binder resin that contains a crystalline resin and a colorant using an apparatus having a heating member and a pressurizing member, wherein the heating member is heated by way of an external heating unit and a surface temperature of the pressurizing member is controlled so as to be at a melting point of the crystalline resin +30° C. or lower.

12. An image fixing method according to claim 11, wherein the external heating unit is an external heating roll.

13. An image fixing method according to claim 11, wherein the surface temperature of the pressurizing member is at a melting point of the crystalline resin in the color toner +Y ° C. or lower in which Y is represented by the following formula:

$$Y=0.3X-18$$

where X represents a transportation speed (mm/sec) of the transfer medium in an image fixing apparatus, which is less than 160 (mm/sec).

14. An image fixing method according to claim 13, wherein the surface temperature of the pressurizing member is controlled by a cooling belt.

15. An image fixing method according to claim 11, wherein the surface temperature of the pressurizing member is controlled by a cooling roll.

16. An image fixing method according to claim 11, further comprising a unit that applies a releasing agent on surfaces of the heating member and the pressurizing member.

17. An image fixing method according to claim 11, wherein a melting point of the crystalline resin is within a range from 40° C. to 120° C.

18. An image fixing method according to claim 11, wherein a content of the crystalline resin in the binder resin is from 20 to 50 wt %.

19. An image fixing method according to claim 11, wherein the binder resin contains an amorphous resin.

* * * * *